US006736697B2

(12) United States Patent
Lienard

(10) Patent No.: US 6,736,697 B2
(45) Date of Patent: May 18, 2004

(54) METAL PART HAVING EXTERNAL SURFACE WITH PARTICULAR PROFILE, POLISHING METHOD FOR ITS PRODUCTION AND DEVICE FOR IMPLEMENTING THE METHOD

(75) Inventor: Alain Lienard, Tracy le Mont (FR)

(73) Assignee: Uranie International, Compiegne (FR)

( * ) Notice: Subject to any disclaimer, the term of this patent is extended or adjusted under 35 U.S.C. 154(b) by 202 days.

(21) Appl. No.: 09/816,065

(22) Filed: Mar. 26, 2001

(65) Prior Publication Data

US 2001/0011001 A1 Aug. 2, 2001

Related U.S. Application Data

(62) Division of application No. 09/147,560, filed on Jan. 20, 1999.

(30) Foreign Application Priority Data

Jun. 5, 1997 (FR) ..... 97 06982
May 29, 1998 (FR) ..... PCT/FR98/01085

(51) Int. Cl.[7] ..... B24B 1/00

(52) U.S. Cl. ..... 451/5; 451/49; 451/11; 451/311; 451/424

(58) Field of Search ..... 451/49, 5, 51, 451/296, 168, 10, 407, 301, 303, 299, 11, 19, 311, 474

(56) References Cited

U.S. PATENT DOCUMENTS

| | | | | | |
|---|---|---|---|---|---|
| 3,101,577 | A | * | 8/1963 | Skugghall | 451/49 |
| 4,105,267 | A | | 8/1978 | Mori | |
| 5,193,314 | A | * | 3/1993 | Wormley et al. | 451/5 |
| 5,231,798 | A | | 8/1993 | Judge et al. | |
| 5,238,311 | A | | 8/1993 | Katou et al. | |
| 5,342,698 | A | | 8/1994 | Fujisawa et al. | |
| 5,433,532 | A | | 7/1995 | Kawageo et al. | |
| 5,643,051 | A | * | 7/1997 | Zhou et al. | 451/11 |
| 5,735,733 | A | * | 4/1998 | Lombardi | 451/307 |
| 5,895,311 | A | * | 4/1999 | Shiotani et al. | 451/5 |
| 5,897,968 | A | | 4/1999 | Dosaka et al. | |
| 6,089,756 | A | | 7/2000 | Ono et al. | |
| 6,171,175 | B1 | * | 1/2001 | Shaikh et al. | 451/28 |

FOREIGN PATENT DOCUMENTS

| | | |
|---|---|---|
| JP | 61-61760 | 3/1986 |
| JP | 06-11038 | 1/1994 |
| WO | WO 95/02486 | 1/1995 |

* cited by examiner

*Primary Examiner*—George Nguyen
(74) *Attorney, Agent, or Firm*—Stuart J. Friedman

(57) ABSTRACT

The invention relates to a circularly-symmetrical metal part (1) having an outer surface (3) which, in axial section, has a general profile made up of a uniform succession of flattened convex arches (4). The invention also relates to a polishing method in which the polishing means move in a tracking motion so as to track the outer surface of the part to be polished, and to apparatus for implementing the polishing method.

2 Claims, 2 Drawing Sheets

METAL PART HAVING EXTERNAL SURFACE WITH PARTICULAR PROFILE, POLISHING METHOD FOR ITS PRODUCTION AND DEVICE FOR IMPLEMENTING THE METHOD

The present invention relates to a circularly-symmetrical metal part having an outer surface that has a particular profile. It also relates to a polishing method enabling the particular profile to be obtained, and to apparatus for implementing the method.

There exist circularly-symmetrical metal parts which have outer surfaces that, in axial section, have profiles made up of non-uniform successions of peaks and valleys.

Such metal parts may, for example, be designed to be used as actuator rods.

In that type of use, in particular for hydraulic actuators, a major problem lies in preventing leaks at the hole through which the rod passes into the actuator body. Gaskets are thus disposed in said hole so as to rub against the rod, thereby sealing the actuator body. However, since the outer surface of the metal part forming the rod has a profile formed of a non-uniform succession of peaks and valleys, it has only a low bearing length ratio. As a result, the contact pressures between the gasket and the outer surface are distributed poorly, and this poor distribution of contact pressures gives rise to excessive wear on the gaskets, thereby leading to oil leaks. That is particularly troublesome since, to replace the sealing elements, it is necessary to stop machines whose high cost and intense operating cycle (they often operate non-stop round the clock) make stopping them for maintenance purposes extremely costly.

After the actuator has been in use for a certain length of time, the outer surface of the metal part forming the rod is "run-in" so that the bearing length ratio increases, thereby reducing the wear on the gaskets. It is thus important for the bearing length ratio to be as high as possible after a running-in time that is as short as possible. Currently, for running-in corresponding to a depth of cut (equivalent to a top portion of the profile of the outer surface being shaved off) equal to 40% of the total height of the profile (corresponding to the height of the highest peak measured from the lowest valley), the bearing length ratio obtained is about 20%. Unfortunately, for such a bearing length ratio, the wear generated remains very high.

In order to reduce the roughness of a surface, it is known, in particular from Document JP-A-61 061760, that a method of treating a surface exists that consists in blunting the peaks of the surface so as to limit the friction wear on a part moving relative to said surface. It has also been proposed, in particular in Document WO-A-95 02486, to use a method of treating a surface by hard anodization. However, the parts obtained by using those methods do not constitute satisfactory solutions to the above-mentioned problems.

In addition, the metal part is sometimes subjected to ambient conditions (humidity, heat, salt spray, etc.) giving rise to oxidation of said part. Such oxidation weakens the metal part and can even cause it to break. In order to avoid that, the outer surface of the metal part is conventionally covered in a stainless coating of chromium. Because of the non-uniformness of the profile of the outer surface, the layer of chromium inevitably has thin zones, and, in such zones, small cracks suffice to expose the outer surface to the surrounding environment. Such exposure then gives rise to harmful oxidation of the metal part.

An object of the invention is to provide a metal part whose outer surface has a particular profile making it possible to obtain a bearing length ratio that is high after a running-in time that is short.

To this end, the invention provides a circularly-symmetrical metal part having a longitudinal axis and an outer surface which, in axial section, has a general profile made up of a uniform succession of flattened convex arches.

Thus, the uniform succession of flattened convex arches procures a bearing length ratio that is high before running-in, so that said ratio reaches its maximum after a running-in time that is very short. The contact pressures between the members that move relative to one another are thus distributed more widely. When the metal part in question is used as an actuator rod, the wear on the sealing elements is thus limited, and the risks of overheating and of seizing are minimized. In addition, the valleys separating the flattened arches from one another are distributed uniformly along the outer surface. In particular in the case of hydraulic actuators, these valleys constitute reserves of oil which facilitate lubrication since they are distributed uniformly along the metal part. Furthermore, such a particular profile makes it possible to deposit a metal coating layer of uniform thickness. The resistance to corrosion is thus further improved.

Advantageously, the outer surface of the metal part is covered with a metal coating layer that has an outer surface which, in axial section, also has a general profile made up of a uniform succession of flattened convex arches.

The metal coating layer covering the outer surface of the metal part is of constant thickness and offers good protection for the metal part. By means of its profile, which is also in the form of flattened convex arches, the coating layer has a bearing length ratio that is high before running in, so that the above-mentioned advantages are reproduced for the coated part, with, in particular low wear on the sealing elements.

Preferably, the shape of the arches and the periodicity of their succession are such that, for depths of cut lying in the range 20% to 50%, the outer surface has a bearing length ratio lying in the range 25% to 95%.

Advantageously, then, the shape of the arches and the periodicity of their succession are such that, for a depth of cut substantially equal to 40%, the outer surface has a bearing length ratio lying in the range 40% to 95%.

Such bearing length ratios at such depths of cut, constitute an excellent compromise between limiting wear on the sealing elements and maintaining sufficient reserves of oil to ensure that lubrication takes place correctly. They also facilitate depositing a coating layer of constant thickness when the metal part is covered with such a layer, with the outer surface of the part then having an analogous particular profile in the form of a succession of flattened convex arches.

The invention also provides a method of polishing the outer surface of a circularly-symmetrical metal part that can have shape defects, the method comprising the steps of setting the metal part in motion relative to a tool and of applying the tool against a zone of the outer surface of the part so that it exerts a force thereon, the tool moving in a tracking motion so as to track the outer surface of the metal part in a radial direction that is essentially normal to said metal part in the zone against which the tool is applied, so that the force exerted by the tool on the part remains constant throughout the entire duration of polishing, regardless of the shape defects present on the surface, until a general profile is obtained that, in axial section, is in the form of a uniform succession of flattened convex arches.

This polishing method thus makes it possible to obtain metal parts having at least one of the above characteristics.

Advantageously, the metal part is supported vertically beneath the tool in a zone of the outer surface that is symmetrical to the zone against which the tool is applied about the longitudinal axis of the metal part.

Finally, the invention provides apparatus for implementing the polishing method having at least one of the above-mentioned characteristics, the apparatus including means for supporting the part and setting it in motion relative to a tool, the tool being mounted on a structure that is mounted to move in a direction substantially normal to the outer surface of the part so as to be applied by an associated force actuator against said surface by exerting a force thereagainst, and means for controlling the displacement of the moving structure as a function of the shape defects on the outer surface of the part.

In a particular embodiment, the tool is essentially constituted by an abrasive belt running over a contact wheel and over a return pulley, the wheel and the pulley forming the moving structure on which said tool is mounted. Preferably, the axle of the return pulley is then mounted to slide in a vertical plane by means of an associated actuator so as to constitute a tensioner pulley.

According to another particular characteristic, a shoe is disposed vertically beneath the tool to support the metal part in a direction substantially normal to the outer surface of said part. Advantageously, then, the position of the shoe can be adjusted by means of an associated actuator in a direction substantially normal to the outer surface of the part. The wear on the shoe can thus be compensated, and its position can be matched to various part diameters for the part to be polished.

Other characteristics and advantages of the invention appear on reading the following description of a non-limiting particular embodiment and implementation of the invention.

Reference is made to the accompanying drawings, in which.

Figure 2:
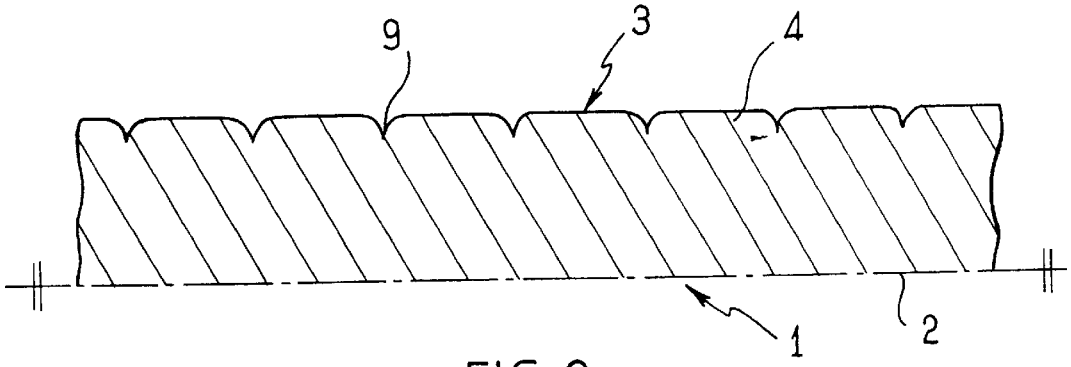
FIG. 2 is a simplified fragmentary view in axial half section of a metal part of the invention, showing the particular profile in the form of a succession of flattened associated arches.
Figure 3:
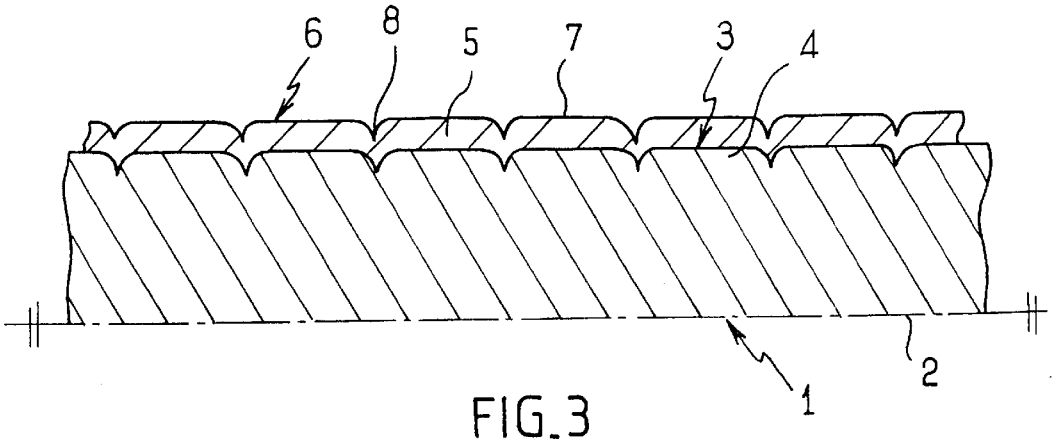
Figure 4:
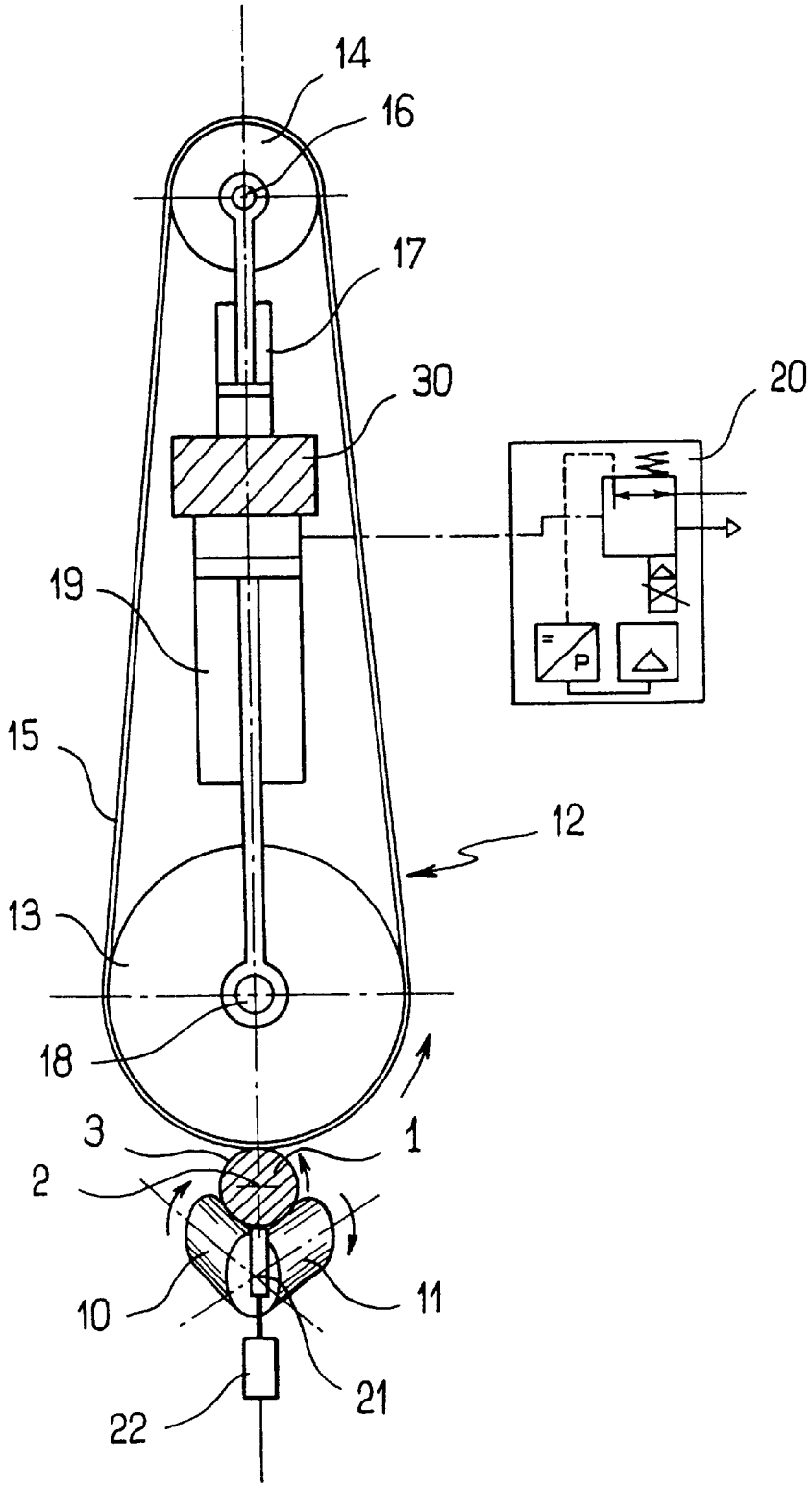

FIG. 3 is a view analogous to the FIG. 2 view, showing a metal part of the invention, as covered with a metal-coating layer whose outer surface also has the particular profile in the form of a succession of flattened convex arches; and FIG. 4 is a diagrammatic fragmentary side view of apparatus for implementing the polishing method enabling the particular profile of the metal part of the invention to be obtained.

FIG. 5 is a top plan view showing a series of rollers 10, 11 uniformly spaced apart for supporting the metal part 1 along its length with the rollers oriented for defining a V-shaped guide in which the metal part 1 is supported. A shoe 21 is provided on the side of the metal part opposite the contact wheel 13 between two pair of rollers 10, 11 for forming a rigid backing element to react against the force applied by contact wheel 13.

Firstly, the meanings of the terms "depth of cut" and "bearing length ratio" are recalled, these terms being used in the present Application in the senses in which the corresponding terms "profondeur de coupe" and "taux de longueur portante" are used in French Standard NF-E-05 015.

Figure 1:
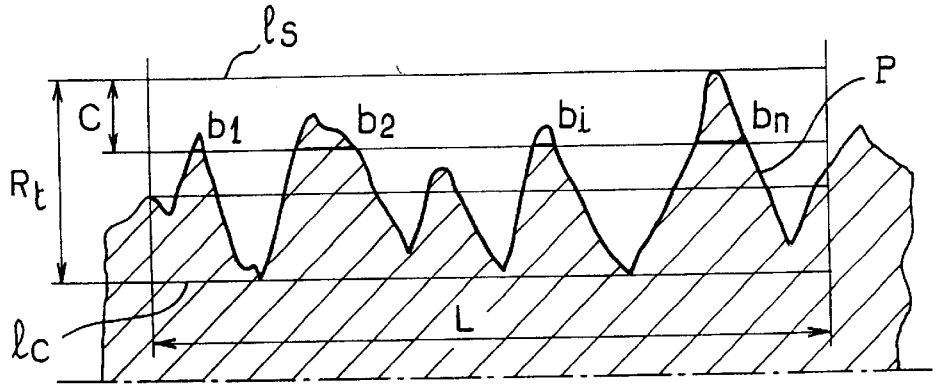
FIG. 1 is a conventional graphical representation showing a surface profile of ordinary type.

FIG. 1 shows a curve representing the profile P, in axial section, of the outer surface of a part of known type. In this example, the profile P is constituted by an alternating succession of peaks and valleys, and it extends over a measurement length L. Such a curve can be obtained by using a roughness meter whose feeler is displaced in contact with the surface over a length L.

The line of peaks is referenced $l_s$ and extends tangentially to the highest peak, and the line of valleys is referenced $l_c$ and it extends tangentially to the lowest valley. The distance between the line of peaks $l_s$ and the line of valleys $l_c$ is the maximum height of the profile and is referenced $R_t$.

The depth of cut c corresponds to a percentage of the maximum height of the profile $R_t$. The lengths of the segments of matter measured at a given depth of cut are referenced $b_i$.

For a given depth of cut c (in %), the bearing length ratio $T_p$ (in %) is given by the following formula:

$$(T_p)_c = \frac{\sum_{i=1}^{i-n} b_i}{L}$$

The metal part of the invention and the means making it possible to form the particular profile of this part are described below in more detail.

With reference to FIG. 2, the metal part of the invention is designated by overall reference 1, and it is a part of cylindrical section made of steel and designed, in this example, to serve as an actuator rod. The metal part 1 has a longitudinal axis 2 and an outer surface 3.

As shown in axial section in FIG. 2, and according to a characteristic of the invention, the outer surface 3 has a profile made up of a uniform succession of flattened convex arches 4. When the metal part 1 is designed to constitute an actuator rod, the shape of the flattened convex arches 4 and the periodicity of their succession are such that the profile of the outer surface 3 has a $(T_p)_{40}$ lying in the range 40% to 95%. In this way, since the $(T_p)_{40}$ is greater than 40%, the sealing elements are not subjected to much wear as a result of them rubbing on the outer surface 3, and since the $(T_p)_{40}$ is less than 95%, sufficient valleys, referenced 9, remain between the flattened convex arches 4 to constitute reserves of oil in order to ensure that the outer surface 3 is lubricated correctly.

FIG. 3 shows a variant of the invention. It shows a metal part 1 analogous to the part shown in FIG. 2 but whose outer surface 3 is covered with a metal coating layer 5, e.g. with a layer of chromium. The outer surface 3 has a profile in the form of a succession of flattened convex arches 4, thereby making it possible to obtain a coating layer 5 of constant thickness, and the outer surface 6 of the layer 5 also has a profile made up of a uniform succession of flattened convex arches 7. The layer 5 thus protects the metal part 1 against oxidation, and it constitutes a contact surface which, by rubbing against the sealing elements of the actuator body, subjects them to only a small amount of wear. Thus, in the variant shown in FIG. 3, the particular profile in the form of a succession of flattened arches is present at the outer surface of the coating layer. Naturally, the layer 5 could be a strength layer or some other layer instead of or in addition to being a protective layer for protecting the part against oxidation.

According to a particularly advantageous characteristic of the variant shown in FIG. 3, the dimensions of the flattened convex arches 7 and the periodicity of their succession are such that the profile of the outer surface 6 of the layer 5 has a $(T_p)_{40}$ lying in the range 40% to 95%.

With reference to FIG. 4, polishing apparatus for forming the above-described metal part 1 includes, in a manner known per se, a series of rollers 10 and 11 uniformly spaced apart and rotatably mounted on a frame (not shown) for supporting the metal part 1 in the manner of a V-shaped guide. The rollers 10 and 11 are connected to a motor so as to drive the metal part 1 in translation in an advance direction that is parallel to the longitudinal axis 2 of the part, and in rotation about the same axis.

Polishing means designated by overall reference 12 are mounted on the frame vertically above the metal part 1 so that they can be applied against the outer surface of the metal part in a direction normal thereto.

The polishing means 12 comprise a contact wheel 13 and a return pulley 14. An abrasive belt 15 constituting the polishing tool is mounted about the wheel and the return pulley.

The return pulley 14 is mounted to be free to rotate about an axle 16 extending parallel to the advance direction. In this example, the axle 16 is mounted on the frame to slide in a vertical plane by means of an associated actuator 17, the axle 16 being mounted at the end of the rod of the actuator 17, and the body of the actuator being fixed to a tool holder 30 mounted on the frame. By means of this configuration, the return pulley 14 is also a tensioner pulley.

The contact wheel 13 is secured to an axle 18 extending parallel to the advance direction. The axle 18 is connected to a motor (not shown) so as to be driven in rotation. The axle 18 is mounted on the frame to slide in a vertical plane by means of a cutting-force actuator 19. The axle 18 is mounted at the end of the rod of the cutting-force actuator 19, and the body of this actuator is fixed to the tool holder 30. The cutting-force actuator 19 is connected to a proportional cutting-force regulator 20 so as to be controlled thereby.

The wheel 13 and the pulley 14, together with their associated support members that connect them to the frame, thus form a structure that is moveable in a direction substantially normal to the part 1.

A shoe 21 is also disposed on the other side of the advance direction from the contact wheel 13, between two pairs of rollers 10 and 11. The shoe 21 is mounted on the frame to slide in a vertical direction. It is secured to a height adjustment member 22 fixed to the frame. The height adjustment member may be an actuator, a slideway associated with a position-locking screw, or any other known means. In this example, the shoe 21 is made of a plastics material having a low coefficient of friction, such as polytetrafluoroethylene. The shoe 21 may also comprise a rotatably mounted contact member.

In operation, the contact wheel 13 is rotated so as to drive the abrasive belt 15 by friction. The metal part 1 is set in motion relative to the polishing means 12 in the advance direction by means of the motor rotating the rollers 10 and 11. The abrasive belt 15 is then applied along a generator line of the contact wheel 13 against a zone of the outer surface 3 of the metal part so as to exert a force on said part in a direction normal to the outer surface. The force is exerted by means of the cutting-force actuator 19. The shoe 21 supports the metal part 1 vertically beneath the polishing means 12 in a zone of the outer surface that is symmetrical to the zone against which the belt is applied about the longitudinal axis 2.

In general, shape of the metal part 1 is not a perfect geometrical shape, but rather it has shape defects such as oval or triangular circularity error, etc. During conventional polishing, performed by means of a fixed contact wheel, such defects give rise to variations in the pass depth and in the cutting force, thereby producing a non-uniform profile for the outer surface. Such defects limit the bearing length ratio that can be obtained.

When such defects are encountered during polishing performed by means of the apparatus of the invention, they exert an opposing force on the belt 15 and on the contact wheel 13, thereby tending to displace them. The contact wheel 13 thus acts as a tracking member for tracking the outer surface of the metal part. This leads to variation in the pressure of the fluid in the full-section chamber of the cutting-force actuator 19. Such pressure variation is immediately detected by the proportional regulator 20 which re-establishes the initial pressure in the full-section chamber of the actuator 19 by releasing or feeding, so that the cutting force exerted by said actuator remains constant for the entire polishing duration.

It is optionally possible to associate regulation (not shown) with the actuator 17 associated with the pulley 14 so that the actuator 17 automatically compensates for the displacements of the contact wheel 13 in order for the tension of the belt to remain constant. This also makes it possible to ensure that the belt 15 is driven effectively by the contact wheel 13.

By supporting the outer surface of the metal part 1, the shoe 21 contributes to maintaining the cutting force constant by forming a rigid backing element reacting against this force and by limiting the deformation of the metal part 1 under the action of the polishing means.

Once it has been polished in this way, the outer surface 3 of the metal part 1 can be covered with the coating layer 5.

The outer surface 6 of the coating layer 5 must then in turn be polished using the polishing method of the invention.

It is easy to understand that the dimensions of the flattened convex arches and the periodicity of their succession can be modified by varying in particular the speed of advance of the metal part and its speed of rotation about the axis of the part. It is quite conceivable for such variation to be performed during polishing so that the layer 5 has an outer surface having different bearing length ratios.

Naturally, the invention is not limited to the above-described embodiment, and variant embodiments are possible without going beyond the ambit of the invention as defined by the claims.

In particular, although the metal part is described in the context of being used subsequently as an actuator rod, its applications are not limited to this use.

Furthermore, although the polishing apparatus is described as including a proportional cutting-force regulator detecting pressure variations, in a variant, it is possible to use an optical or mechanical shape-defect detector disposed upstream from the polishing means relative to the advance direction. The cutting-force actuator is then connected to the detector by a servo-control link.

Finally, the abrasive belt could be replaced with a grinding wheel whose axle is coupled to the rod of the cutting-force actuator.

What is claimed is:

1. A method of polishing the outer surface of a circularly-symmetrical metal part that can have shape defects, the method comprising the steps of:

(a) setting the metal part (1) in motion relative to a polishing tool (15);

(b) applying the tool (15) against a zone of the outer surface of the part so that said tool exerts a force thereon; and (c) during application of said tool against said zone, moving the tool (15) in a tracking motion so as to track the outer surface of the metal part (1) in a radial direction that is essentially normal to said metal part in the zone against which the tool is applied, so that the force exerted by the tool (15) on the part (1) remains constant throughout the entire duration of polishing regardless of the shape defects present on the surface.

2. A method, according to claim 1, comprising the step of supporting the metal part (1) vertically beneath the tool (15) in a zone of the outer surface that is symmetrical to the zone against which the tool is applied about the longitudinal axis of the metal part.

* * * * *